US008881951B2

(12) United States Patent
Hwang et al.

(10) Patent No.: US 8,881,951 B2
(45) Date of Patent: Nov. 11, 2014

(54) REFRIGERATOR

(75) Inventors: Jungyeon Hwang, Gyeongsangnam-do (KR); Jinwon Kang, Gyeongsangnam-do (KR); Myungdong You, Gyeongsangnam-do (KR); Woonkyu Seo, Gyeongsangnam-do (KR); Hanjin Jung, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 94 days.

(21) Appl. No.: 13/696,091

(22) PCT Filed: May 6, 2011

(86) PCT No.: PCT/KR2011/003395

§ 371 (c)(1),
(2), (4) Date: Dec. 11, 2012

(87) PCT Pub. No.: WO2011/139116

PCT Pub. Date: Nov. 10, 2011

(65) Prior Publication Data

US 2013/0075424 A1 Mar. 28, 2013

(30) Foreign Application Priority Data

May 6, 2010 (KR) ..... 10-2010-0042236
May 6, 2010 (KR) ..... 10-2010-0042237

(51) Int. Cl.

| | |
|---|---|
| ***B67D 7/80*** | (2010.01) |
| ***F25D 23/12*** | (2006.01) |
| ***F25D 23/04*** | (2006.01) |

(52) U.S. Cl.

CPC ..... *F25D 23/12* (2013.01); *F25D 23/04* (2013.01); *F25D 23/126* (2013.01)

USPC ..... 222/146.1; 222/146.6; 62/389

(58) Field of Classification Search

CPC ..... F25D 2323/02; F25D 2323/121; F25D 2323/122; F25D 23/02; F25D 23/121; F25D 23/122; F25D 23/12; F25D 23/04; F25D 23/126; F25C 5/005

USPC ..... 222/182, 505, 508, 111, 533, 534, 222/146.1, 146.6; 62/388–391

See application file for complete search history.

(56) References Cited

U.S. PATENT DOCUMENTS

| | | | | |
|---|---|---|---|---|
| 4,209,999 | A * | 7/1980 | Falk et al. | 62/344 |
| 7,383,689 | B2 * | 6/2008 | Lee et al. | 62/98 |
| 7,958,742 | B2 * | 6/2011 | Park et al. | 62/389 |
| 8,001,796 | B2 * | 8/2011 | Kim et al. | 62/66 |

(Continued)

OTHER PUBLICATIONS

International Search Report dated Dec. 26, 2011 for Application No. PCT/KR2011/003395, 3 pages.

*Primary Examiner* — Lien Ngo
(74) *Attorney, Agent, or Firm* — Fish & Richardson P.C.

(57) ABSTRACT

Provided is a dispenser of a refrigerator. A body of the dispenser can move back and forth. Only when a water or ice dispensing command is input, the body is moved to form a container receiving space. Thus, it is difficult to discriminate the dispenser from a refrigerator door when the dispenser is not operated.

22 Claims, 16 Drawing Sheets

(56) References Cited

U.S. PATENT DOCUMENTS

| | | | | |
|---|---|---|---|---|
| 8,141,748 | B2 * | 3/2012 | Kim | 222/182 |
| 8,196,426 | B2 * | 6/2012 | Kang | 62/389 |
| 8,217,613 | B2 * | 7/2012 | Yoo et al. | 318/466 |
| 2005/0268638 | A1 | 12/2005 | Voglewede et al. | |
| 2006/0086136 | A1 | 4/2006 | Maritan et al. | |
| 2006/0144074 | A1 | 7/2006 | Bowen et al. | |
| 2007/0119516 | A1 | 5/2007 | Heger et al. | |
| 2012/0181304 | A1 * | 7/2012 | Kim | 222/182 |

* cited by examiner

REFRIGERATOR

CROSS REFERENCE TO RELATED APPLICATIONS

This application is a U.S. National Phase Application under 35 U.S.C. §371 of International Application PCT/KR2011/003395, filed on May 6, 2011, which claims the benefit of Korean Application Nos. 10-2010-0042237 and 10-2010-0042236, filed on May 6, 2010, the entire contents of the prior applications are hereby incorporated by reference in their entireties.

TECHNICAL FIELD

The present disclosure relates to a refrigerator.

BACKGROUND ART

Refrigerators are electric appliances for storing foods at low temperature.

Such a refrigerator uses a refrigerating cycle including a compressor, a condenser, an expansion device, and an evaporator, and supplies cool air generated by the evaporator, to a food storing space.

Refrigerators may be classified into top-mount-type refrigerators, side-by-side-type refrigerators, and bottom-freezer-type refrigerators, according to positions of a refrigerator compartment and a freezer compartment. In top-mount-type refrigerators, a freezer compartment is disposed over a refrigerator compartment. In side-by-side-type refrigerators, a freezer compartment and a refrigerator compartment are disposed on the left and right sides, respectively. In bottom-freezer-type refrigerators, a freezer compartment is disposed under a refrigerator compartment.

Recently, refrigerators having a dispenser door for dispensing water or ice without opening a refrigerator door are commercialized as well as refrigerators having a home bar door through which a food can be taken out without opening a refrigerator door.

Such a dispenser door includes a dispenser recessed from the front surface thereof. Thus, a rear surface of the dispenser door including the dispenser protrudes rearward, thereby reducing the inner volume of the refrigerator.

DISCLOSURE OF INVENTION

Technical Problem

Embodiments provide a refrigerator including a dispenser to slim the rear part of a refrigerator door, thereby increasing the inner volume of the refrigerator.

Embodiments also provide a refrigerator including a dispenser having a shallow recess, thereby improving the appearance of the refrigerator.

Embodiments also provide a refrigerator including a dispenser that is substantially flush with the front surface of a refrigerator door or is slightly recessed therefrom when the dispenser is not operated, and that is moved reward only when being operated.

Embodiments also provide a refrigerator including a door basket having a separate storage space that is separated from external air when a refrigerator door is opened.

Embodiments also provide a refrigerator having a structure for easily opening and closing a storage space of a door basket.

Solution to Problem

In one embodiment, a refrigerator includes: a main body having a storage space therein; a door selectively opening and closing the storage space; and a dispenser assembly provided to the door to dispense water or ice, wherein a wall constituting the dispenser assembly moves rearward according to a water or ice dispensing command, and the moving of the wall forms a container receiving part for receiving a container containing water or ice.

In another embodiment, a refrigerator includes: a main body having a storage space therein; a door selectively opening and closing the storage space; and a door basket disposed on a rear surface of the door and defining a separate storage space, and the door basket includes: a bottom; a body extending from the bottom and having an opening; an upper part placed on an upper end of the body; a pair of covers selectively opening and closing the opening of the body; and a driving mechanism configured such that one of the covers is automatically moved by moving the other.

The details of one or more embodiments are set forth in the accompanying drawings and the description below. Other features will be apparent from the description and drawings, and from the claims.

Advantageous Effects of Invention

According to the embodiments, when a dispenser for dispensing water or ice is not operated, a dispenser body is substantially flush with the front surface of a refrigerator door, or is slightly recessed from the front surface. Thus, when viewed from the front side of a refrigerator, it is difficult to discriminate the dispenser from the refrigerator door.

In addition, when water or ice is not dispensed, a tray is disposed inside a dispenser housing, thus preventing a foreign substance from being stacked on the tray.

A display appears only when an ice or water dispensing command is input, and thus, a front appearance of the refrigerator door is neat.

Since the dispenser has a shallower recess to receive a container than the recess of a typical dispenser, the size of a part protruding from the rear surface of the refrigerator door is reduced, thus increasing the volume of the refrigerator.

One of covers constituting a door basket of the refrigerator is automatically opened by opening the other. Thus, while a user opens the cover with his/her hand, the user can put in or take out a food from the door basket with the other hand.

MODE FOR THE INVENTION

Reference will now be made in detail to the embodiments of the present disclosure, examples of which are illustrated in the accompanying drawings. The spirit and scope of the present disclosure, however, shall not be construed as being limited to embodiments provided herein. Rather, it will be apparent that other embodiments that fall within the spirit and scope of the present disclosure may easily be derived through adding, modifying, and deleting elements herein.

Hereinafter, a dispenser of a refrigerator according to an embodiment will now be described in detail with reference to the accompanying drawings.

Figure 1:
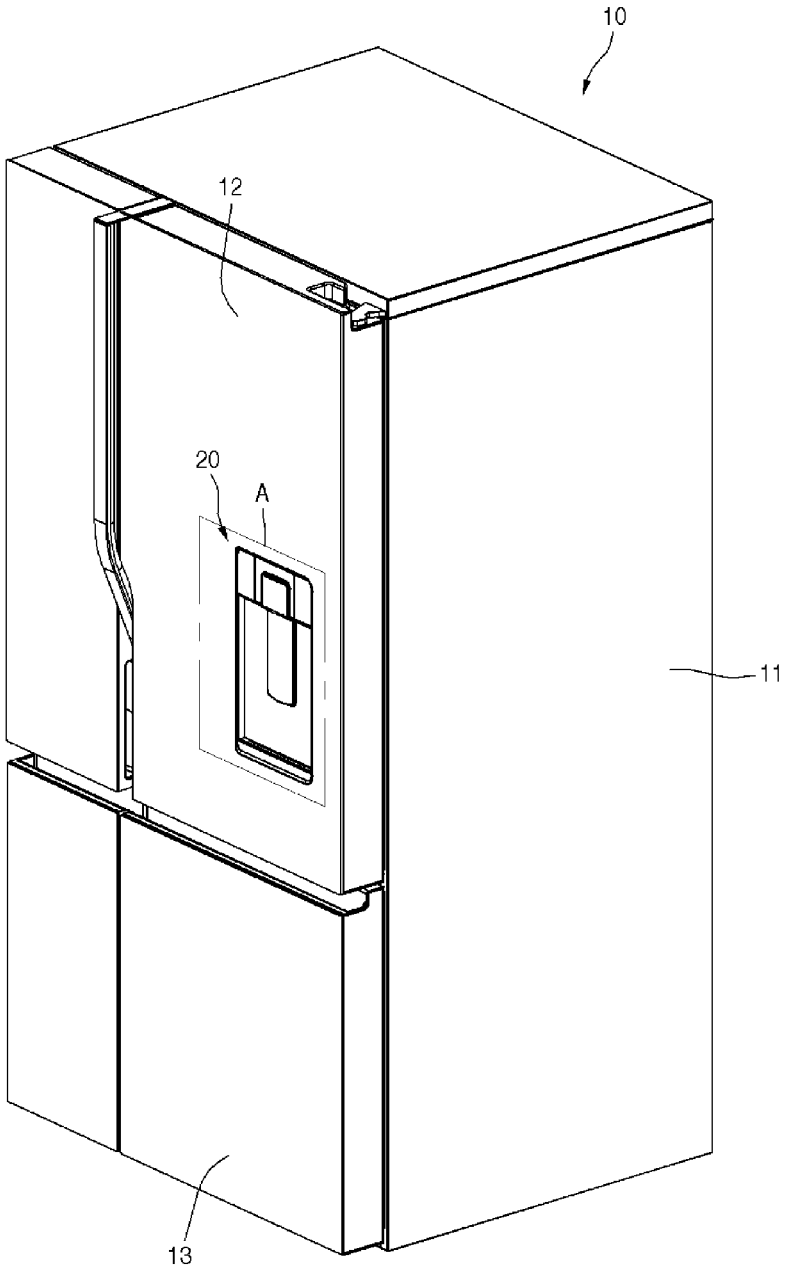
FIG. 1 is a perspective view illustrating a refrigerator according to a first embodiment.

FIG. 1 is a perspective view illustrating a refrigerator according to a first embodiment.

Referring to FIG. 1, a refrigerator 10 according to the current embodiment includes: a main body 11 having a refrigerator compartment and a freezer compartment therein; a refrigerator door 12 selectively opening and closing the refrigerator compartment; and a freezer door 13 selectively opening and closing the freezer compartment.

In detail, the refrigerator door 12 may be a rotary door rotating about a vertical axis, and the freezer door 13 may be a drawer-type door sliding back and forth.

A dispenser assembly 20 is installed on the front surface of the refrigerator door 12. According to another embodiment, the dispenser assembly 20 may be installed on a refrigerator or freezer door of a side-by-side-type refrigerator.

Figure 2:
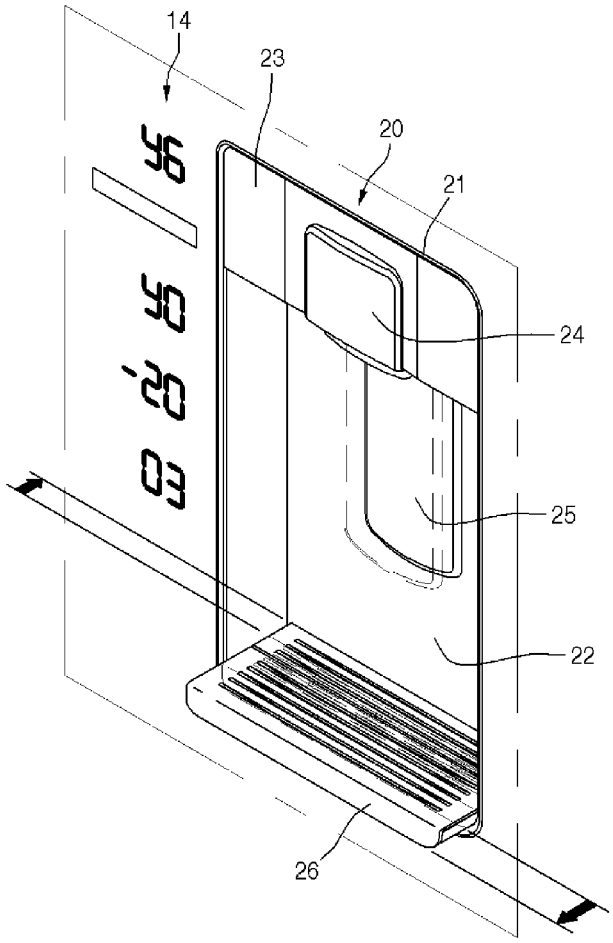
FIG. 2 is an enlarged view illustrating a portion A of FIG. 1.

FIG. 2 is an enlarged view illustrating a portion A of FIG. 1.

Referring to FIG. 2, the dispenser assembly 20 may be installed on the front surface of the refrigerator door 12 or the freezer door 13.

In detail, a recess for receiving the dispenser assembly 20 is disposed in the refrigerator door 12 or the freezer door 13. A display 14 may be disposed at a side of the dispenser assembly 20. Only when the dispenser assembly 20 operates to dispense water or ice, the display 14 displays information including the temperature of water and an inner temperature of the refrigerator 10. That is, when the dispenser assembly 20 is not used, the display 14 does not display any information. Just when a command of dispensing water or ice is input, the information including the temperature of water and an inner temperature of the refrigerator 10 is activated and displayed to the outside. To this end, a fade-in/out-type display method may be used in which the brightness of a display gradually increases and gradually decreases.

The dispenser assembly 20 includes: a dispenser housing 21; a dispenser head 23 disposed inside the dispenser housing 21; a dispenser body 22 extending from the lower end of the dispenser head 23 to the lower end of the dispenser housing 21; and a tray 26 disposed between the lower end of the dispenser body 22 and the lower end of the dispenser housing 21 and protruded forward and retracted rearward. The dispenser body 22 may be provided with an ice dispensing button 25. According to the current embodiment, the ice dispensing button 25 is vertically elongated approximately at the central part of the dispenser body 22, but is not limited thereto. The dispenser body 22 can slide back and forth according to manipulation of the ice dispensing button 25.

The dispenser housing 21 has a front opening, and a surface of the dispenser housing 21 passing through a front edge thereof may be substantially flush with the front surface of the refrigerator door 12 provided with the dispenser assembly 20.

Hereinafter, a configuration and an operation of the dispenser assembly 20 will now be described in detail with reference to the accompanying drawings.

Figure 3:
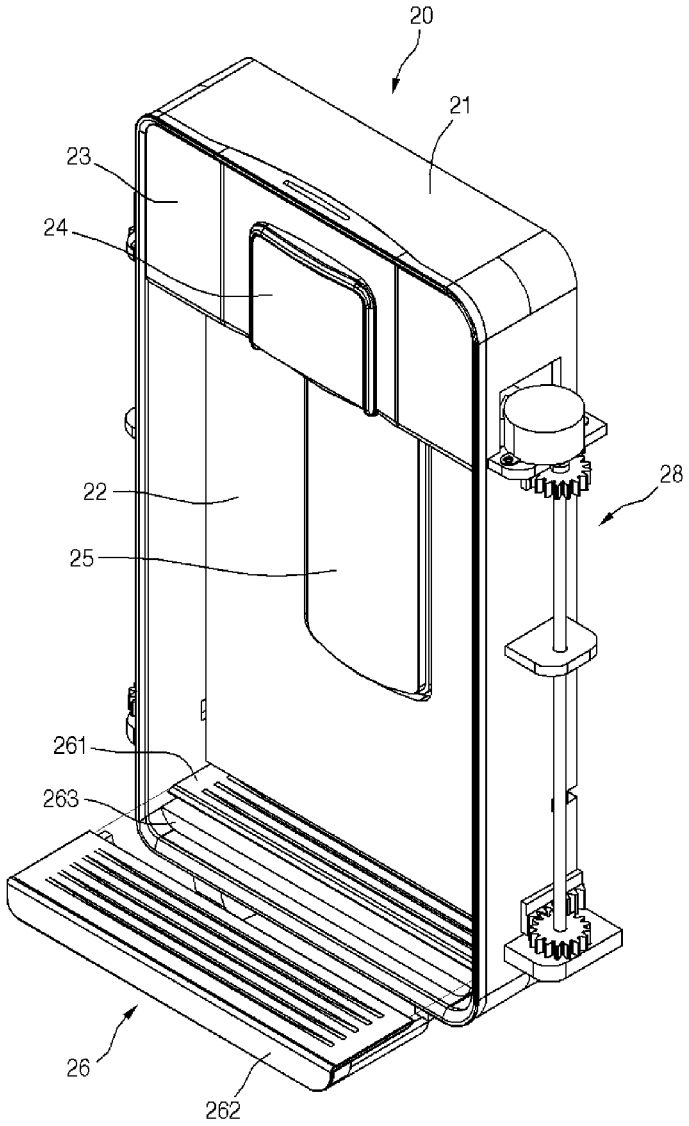
FIGS. 3 and 4 are perspective views illustrating the front part of a dispenser assembly according to an embodiment.
Figure 4:
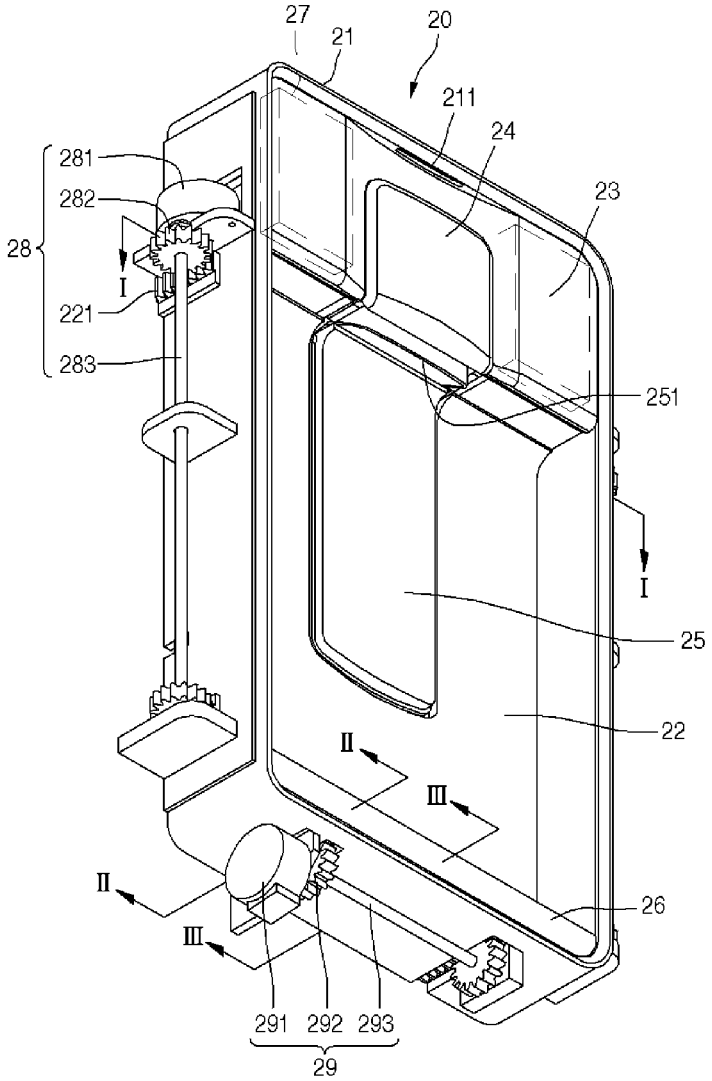
Figure 5:
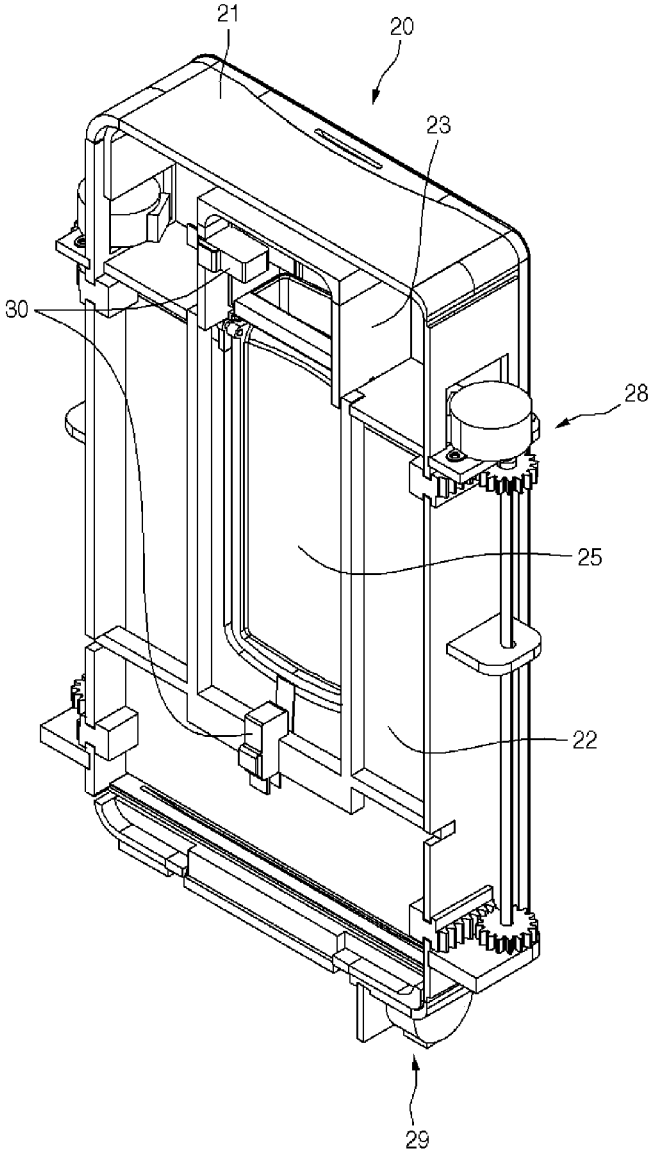
FIG. 5 is a perspective view illustrating the rear part of the dispenser assembly of FIGS. 3 and 4.

FIGS. 3 and 4 are perspective views illustrating the front part of a dispenser assembly according to the current embodiment. FIG. 5 is a perspective view illustrating the rear part of the dispenser assembly of FIGS. 3 and 4.

Referring to FIGS. 3 to 5, the dispenser assembly 20 includes the dispenser housing 21, the dispenser body 22, and the dispenser head 23, and the tray 26, as described above.

In detail, a control part 27 for controlling an operation of the dispenser assembly 20 may be placed on the rear surface of the dispenser head 23.

First driving parts 28 for moving the dispenser body 22 back and forth may be installed on both side surfaces of the dispenser housing 21, respectively. A second driving part 29 for moving the tray 26 back and forth may be installed on the bottom surface of the dispenser housing 21.

The front end of the top surface of the dispenser housing 21 is provided with a water dispensing hole 211. When a water dispensing button 24 is pressed, water from a water tap (not shown) disposed on the vertical upper side of the water dispensing hole 211 is dispensed through the water dispensing hole 211.

The dispenser body 22 is recessed a predetermined distance rearward from the dispenser head 23 to facilitate the dispensing of ice. In other words, a stepped part having a predetermined length in the back-and-forth direction is disposed between the lower end of the dispenser head 23 and the upper end of the dispenser body 22. An outlet of an ice chute 251 may be disposed in the stepped part. According to the current embodiment, the front surface of the dispenser body 22 is recessed rearward from the front surface of the dispenser head 23, but is not limited thereto. For example, when an ice dispensing command is not input, the front surface of the dispenser head 23, the front surface of the dispenser body 22, and the front surface of the refrigerator door 12 are flush with one another. When the ice dispensing button 25 is pressed, and the ice dispensing command is input, the dispenser body 22 moves rearward to expose the ice chute 251. Although not shown, a discharge duct for dispensing ice is disposed in the refrigerator door 12, and includes an outlet end communicating with an inlet end of the ice chute 251. An ice maker and an ice bin for storing ice made in the ice maker may be installed on the rear surface of the refrigerator door 12, or in the refrigerator 10. The ice maker, the ice bin, and the discharge duct may have any structures applied to a typical refrigerator.

The tray 26 includes a stationary tray 261 that is fixed in the dispenser housing 21, a moving tray 262 that is moved forward, and a slide guide 263 that guides a movement of the moving tray 262.

In detail, the slide guide 263 is accommodated in the moving tray 262, and supports and guides the moving tray 262 to allow a horizontal movement of the moving tray 262. The slide guide 263 is fixed in the dispenser housing 21.

The stationary tray 261 fixed to the top surface of the slide guide 263 is just moved vertically by elastic force while the moving tray 262 is protruded or retracted. A structure for operating the stationary tray 261 will be described later in detail with reference to the accompanying drawings.

When a command for dispensing water or ice is input, the moving tray 262 protrudes forward. When the dispensing of water or ice is completed, the moving tray 262 is retracted in the dispenser housing 21.

The first driving parts 28 are connected to the upper and/or lower portions of the sides of the dispenser body 22 to move the dispenser body 22 in a standing state.

In detail, the first driving part 28 may include a driving motor 281, a shaft 283 connected to a rotation shaft of the driving motor 281, and pinions 282 connected to the shaft 283 and rotating together with the shaft 283. The pinions 282 engage with racks 221 disposed on the side of the dispenser body 22.

The second driving part 29 may include a driving motor 291, a shaft 293, and pinions 292, like the first driving parts 28. The pinions 292 engage with racks (to be described later) disposed on the bottom surface of the moving tray 262. The first driving parts 28 and the second driving part 29 may be controlled by the control part 27.

Switches 30 may be connected to the rear surface of the water dispensing button 24 and the rear surface of the ice dispensing button 25 to generate a command signal for dispensing water or ice. The switches 30 may be typical micro switches, but are not limited thereto. When the water dispensing button 24 or the ice dispensing button 25 is pressed, the switch 30 is turned on, and a switch-on signal is transmitted to a control part, so that water or ice can be dispensed.

Figure 6:
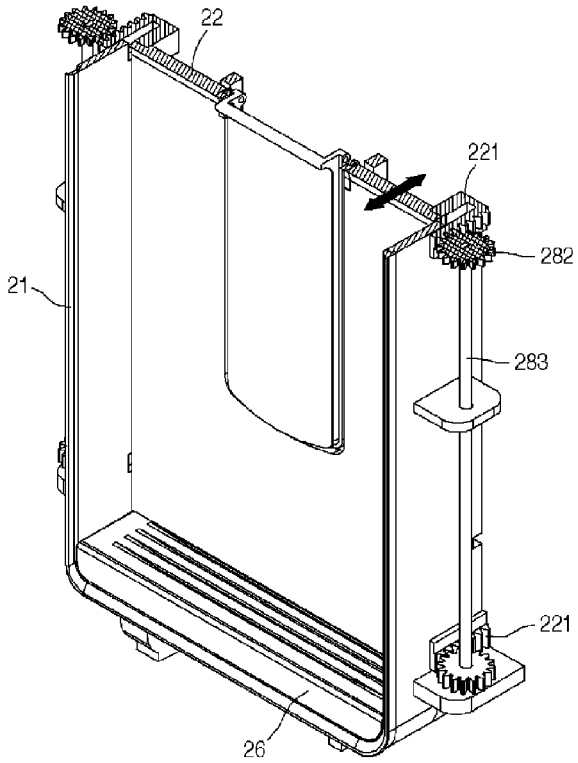
FIG. 6 is a cut-away perspective view taken along line I-I of FIG. 4.

FIG. 6 is a cut-away perspective view taken along line I-I of FIG. 4.

Referring to FIG. 6, the racks 221 may be disposed on the side surfaces of the dispenser body 22. Since the pinions 282 engage with the racks 221, the dispenser body 22 can slide forward or rearward according to a rotation direction of the pinions 282. In detail, when the dispenser body 22 slides rearward, a space for receiving a container, that is, a container receiving part is formed inside the dispenser housing 21.

According to a control program, the tray 26 may be protruded forward only when an ice dispensing command is input. When a water dispensing command is input as well as the ice dispensing command, the tray 26 may be protruded forward.

Figure 7:
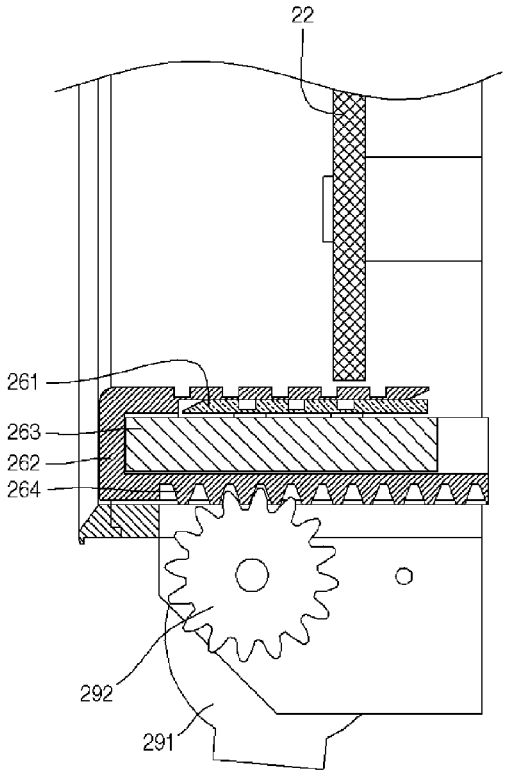
FIG. 7 is a cross-sectional view taken along line II-II of FIG. 4.
Figure 8:
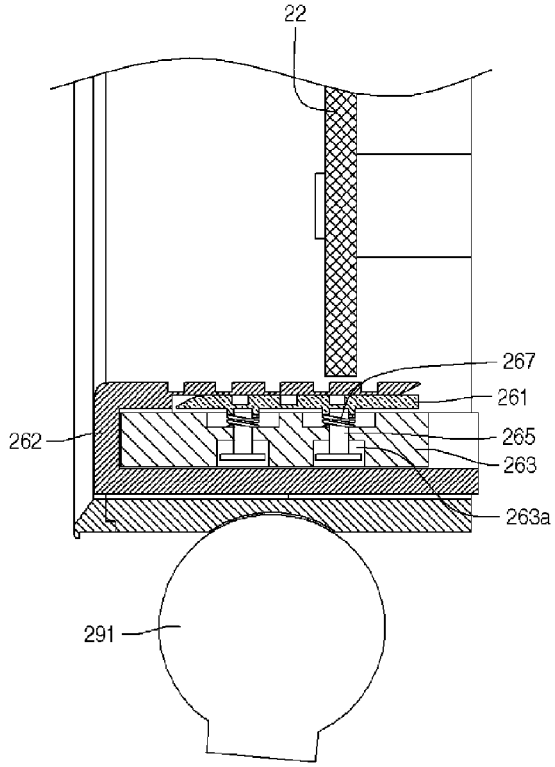
FIG. 8 is a cross-sectional view taken along line III-III of FIG. 4.

FIG. 7 is a cross-sectional view taken along line II-II of FIG. 4. FIG. 8 is a cross-sectional view taken along line III-III of FIG. 4.

Referring to FIGS. 7 and 8, the stationary tray 261 is connected to the slide guide 263, and the moving tray 262 surrounds the stationary tray 261 and the slide guide 263. Since the pinions 292 engage with racks 264 disposed on the bottom surface of the moving tray 262, the moving tray 262 can slide forward or rearward according to a rotation direction of the pinions 292. The moving tray 262 can move back and forth without shaking by the slide guide 263.

The stationary tray 261 connected to the slide guide 263 can vertically move. In detail, supports 265 having a boss shape are inserted in the slide guide 263, and elastic members 267 such as a spring are fitted on circumferential surfaces of the supports 265. Thus, the supports 265 can be moved a predetermined vertical distance by elastic force of the elastic members 267, so that the stationary tray 261 can be vertically moved. The supports 265 may be fixed to the bottom surface of the stationary tray 261, or be just fitted in a sleeve or a recess formed in the bottom surface of the stationary tray 261, as illustrated in FIG. 8. An upward moving distance of the stationary tray 261 is limited by the lower end of the dispenser body 22. As a result, the stationary tray 261 can move only in the vertical direction inside the dispenser housing 21.

Figure 9:
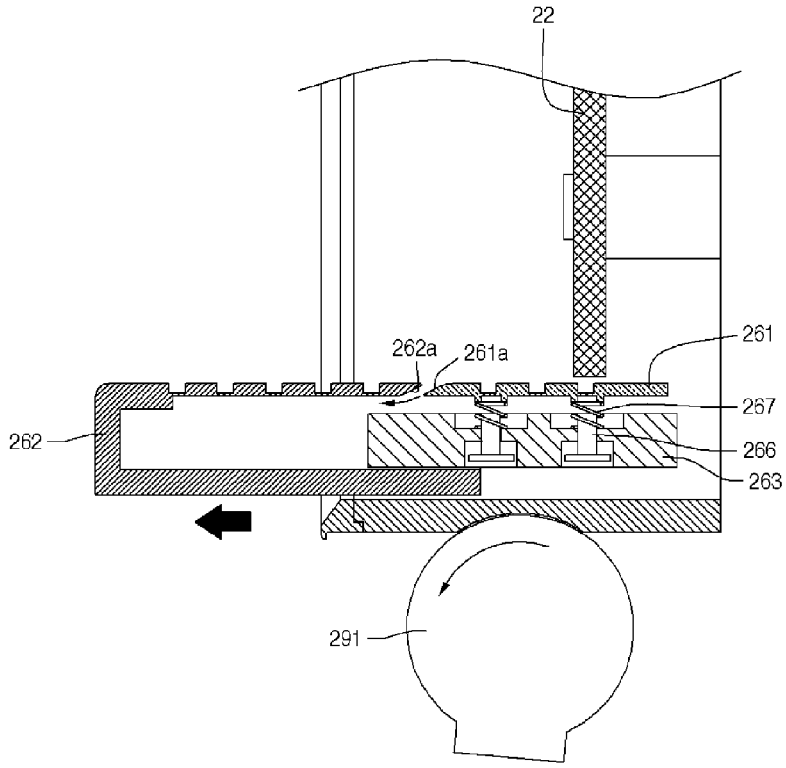
FIG. 9 is a cross-sectional view illustrating a protruding state of a moving tray constituting a tray, according to an embodiment.

FIG. 9 is a cross-sectional view illustrating a protruding state of a moving tray constituting a tray, according to the current embodiment.

Referring to FIG. 9, when the water dispensing button 24 or the ice dispensing button 25 is manipulated to input a command for dispensing water or ice, the driving motor 291 of the second driving part 29 operates. Then, the pinions 292 are rotated, and thus, the moving tray 262 is protruded forward.

In detail, the rear end of the upper part of the moving tray 262, and the front end of the stationary tray 261 may have slopes 262*a* and 261*a* having the same inclination angle, respectively. While the moving tray 262 is completely protruded, the stationary tray 261 is moved upward by the elastic force of the elastic members 267. At this point, the slopes 262*a* and 261*a* contact each other, and thus, the stationary tray 261 is smoothly moved upward. Also when the moving tray 262 is moved rearward, the slopes 262*a* and 261*a* contact each other, and thus, the stationary tray 261 is smoothly moved downward. After the moving tray 262 is completely protruded, when the stationary tray 261 has been moved upward, the top surface of the moving tray 262 is flush with the top surface of the stationary tray 261.

As described above, when a command for dispensing water or ice is not input yet, the dispenser body 22 stays at the front side. Only when the command for dispensing water or ice is input, the dispenser body 22 is moved rearward to form a space for receiving a container, and the tray 26 is protruded. Thus, when the command for dispensing water or ice is not input, the dispenser body 22 is substantially flush with the front surface of the refrigerator door 12, or is slightly recessed from the front surface thereof. Accordingly, when viewed from the front side of the refrigerator 10, it is difficult to discriminate the dispenser from the refrigerator door 12. In addition, since the tray 26 is disposed inside the dispenser housing 21, a foreign substance is prevented from being stacked on the tray 26.

In addition, since the dispenser according to the current embodiment has a shallower recess to receive a container than a typical dispenser does, the size of a part protruding from the rear surface of the refrigerator door 12 is reduced, thus increasing the inner volume of the refrigerator 10.

Figure 10:
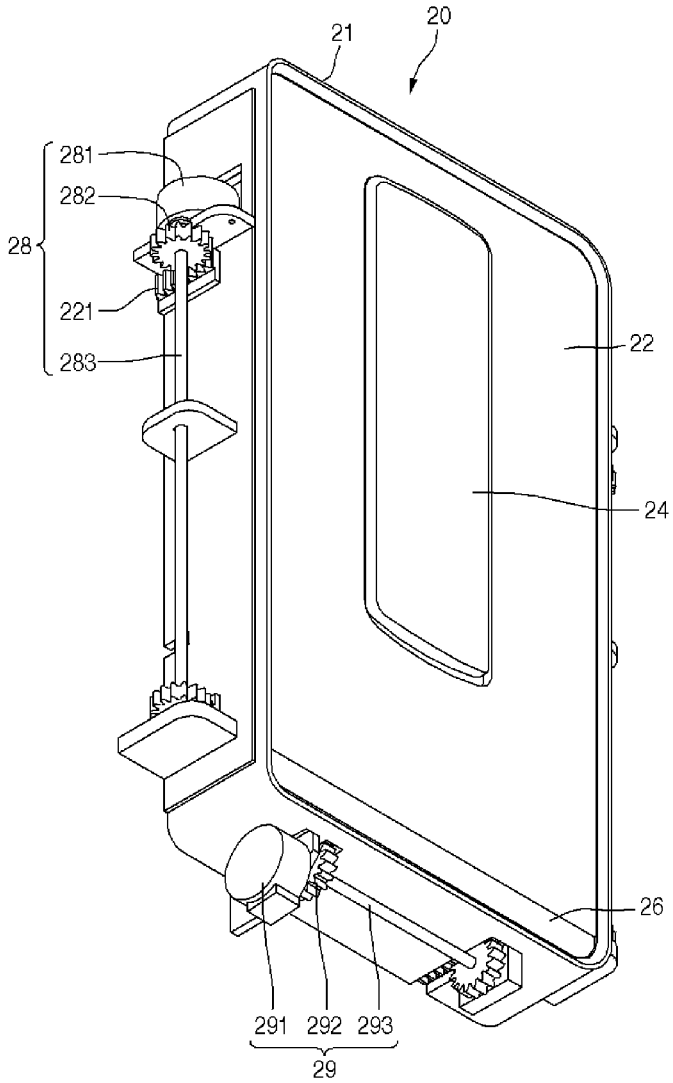
FIG. 10 is a perspective view illustrating the front part of a dispenser assembly according to a second embodiment.
Figure 11:
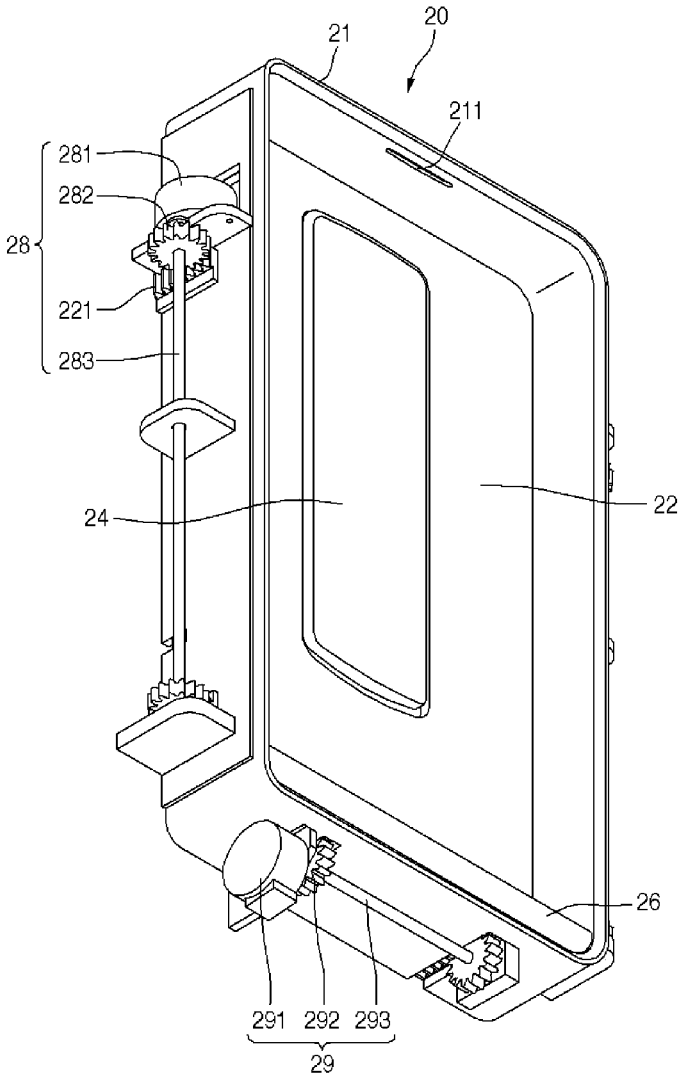
FIG. 11 is a perspective view illustrating an operation of the dispenser assembly of FIG. 10.

FIG. 10 is a perspective view illustrating the front part of a dispenser assembly according to a second embodiment. FIG. 11 is a perspective view illustrating an operation of the dispenser assembly of FIG. 10.

Referring to FIGS. 10 and 11, a dispenser assembly 20 according to the current embodiment includes a dispenser housing 21, a dispenser body 22 moving back and forth inside the dispenser housing 21, and a water dispensing button 24 disposed on the dispenser body 22. A water dispensing hole 211 is disposed in the top surface of the dispenser housing 21.

In the current embodiment, only water is dispensed from the dispenser assembly 20. Thus, an opening of the dispenser housing 21 is covered by the dispenser body 22, and a rearward movement of the dispenser body 22 exposes the water dispensing hole 211, and forms a container receiving part for receiving a water container.

Figure 12:
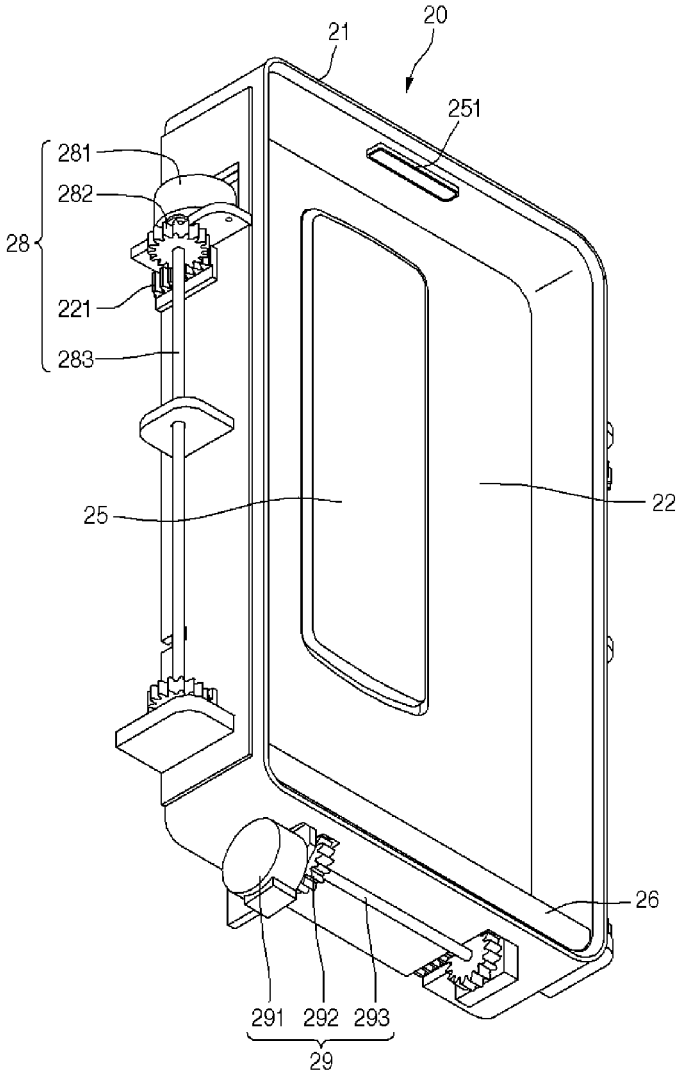
FIG. 12 is a perspective view illustrating an operation of a dispenser assembly according to a third embodiment.

FIG. 12 is a perspective view illustrating an operation of a dispenser assembly according to a third embodiment.

Referring to FIG. 12, in the current embodiment, only ice is dispensed through a dispenser assembly 20, unlike the second embodiment.

In detail, an ice chute 251 is disposed in the top surface of a dispenser housing 21, and is selectively exposed according to a back and forth movement of a dispenser body 22. Only an ice dispensing button 25 is disposed on the dispenser body 22. Since the other parts of the dispenser assembly 20 according to the current embodiment are the same as those of the previous embodiment, a description thereof will be omitted.

Figure 13:
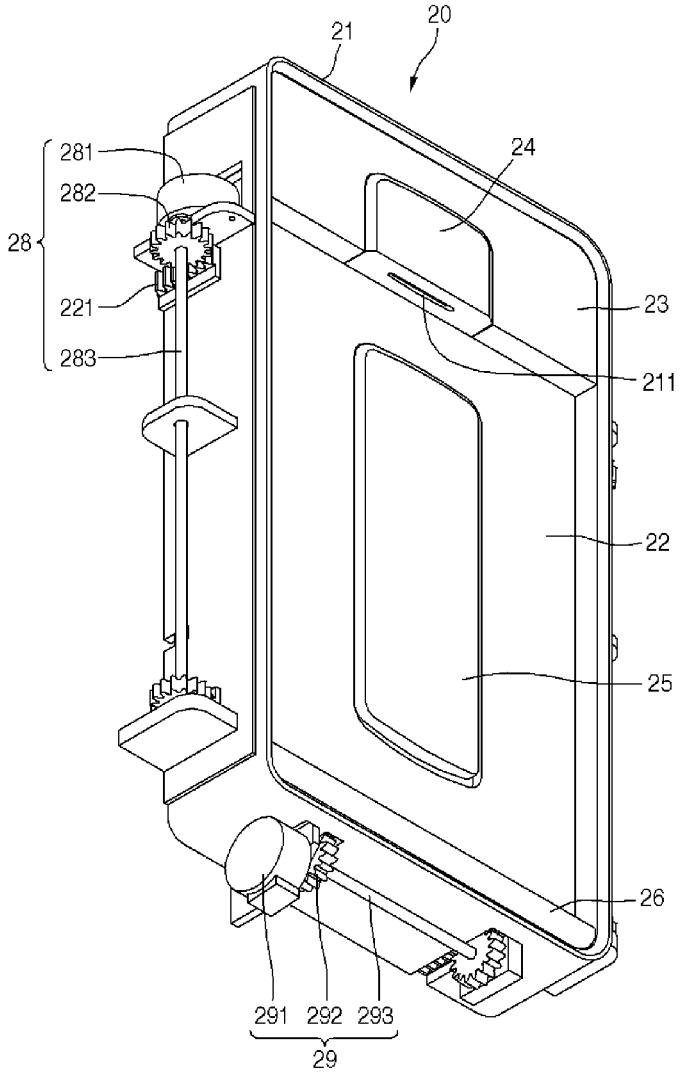
FIGS. 13 and 14 are perspective views illustrating operations of a dispenser assembly according to a fourth embodiment.
Figure 14:
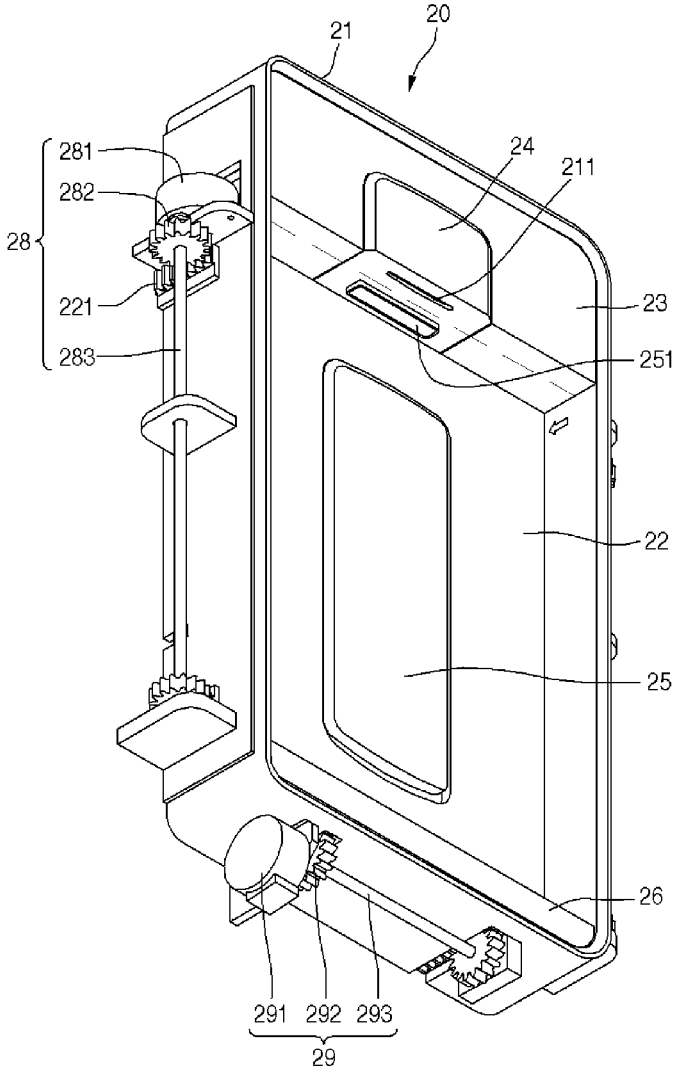

FIGS. 13 and 14 are perspective views illustrating operations of a dispenser assembly according to a fourth embodiment.

Referring to FIGS. 13 and 14, a dispenser assembly 20 according to the current embodiment is the same in structure as the dispenser assembly 20 according to the first embodiment. However, a water dispensing hole 211 and an ice chute 251 are disposed in a stepped surface between a dispenser head 23 and a dispenser body 22, and an operation of the dispenser body 22 is varied according to a command for dispensing water or ice.

In detail, the water dispensing hole 211 is disposed in front of the ice chute 251, and is spaced apart from the ice chute 251.

When a water dispensing command is input, the dispenser assembly 20 operates as illustrated in FIG. 13. When the water dispensing button 24 is pressed, the dispenser body 22 is moved rearward. However, the dispenser body 22 is not fully moved rearward, and is moved through a certain distance to just expose the water dispensing hole 211.

When an ice dispensing command is input, the dispenser assembly 20 operates as illustrated in FIG. 14. When an ice dispensing button 25 is pressed, the dispenser body 22 is fully moved rearward to expose the ice chute 251. In this case, the tray 26 may be protruded forward when at least one of water and ice is dispensed.

When the dispenser assembly 20 is not operated, the front surface of the dispenser head 23 may be flush with the front surface of the dispenser body 22. Furthermore, the dispenser head 23, the dispenser body 22, and the front surface of a refrigerator door may be flush with one another.

Hereinafter, a door basket of a refrigerator according to an embodiment will now be described in detail with reference to the accompanying drawings.

Figure 15:
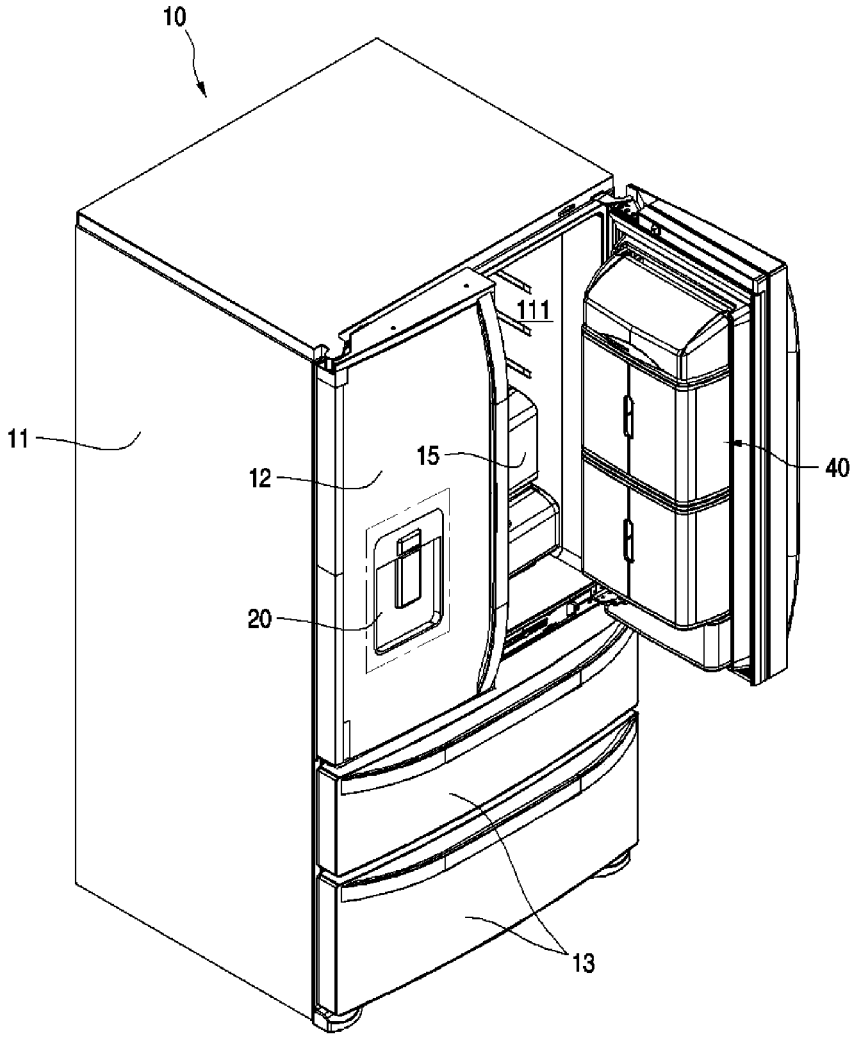
FIG. 15 is a perspective view illustrating a refrigerator according to an embodiment.

FIG. 15 is a perspective view illustrating a refrigerator according to an embodiment.

Referring to FIG. 15, a refrigerator 10 according to the current embodiment may include: a main body 11 including a refrigerator compartment 111 and a freezer compartment (not shown) therein; refrigerator doors 12 for selectively opening and closing the refrigerator compartment 111; freezer doors 13 for selectively opening and closing the freezer compartment; one or more door baskets 40 provided to the rear surface of the refrigerator door 12; and a dispenser assembly 20 disposed in the front surface of the refrigerator door 12 to dispense water or ice. A plurality of storage boxes 15 may be accommodated in the refrigerator compartment 111. According to another embodiment, the door baskets 40 and the dispenser assembly 20 may be installed on a freezer door of a side-by-side-type refrigerator as well as a refrigerator door.

In detail, the door basket 40 may be removably installed on the rear surface of the refrigerator door 12, and be provided in plurality at the upper and lower sides.

Hereinafter, a structure and an operation of the door basket 40 will now be described in detail with reference to the accompanying drawings.

Figure 16:
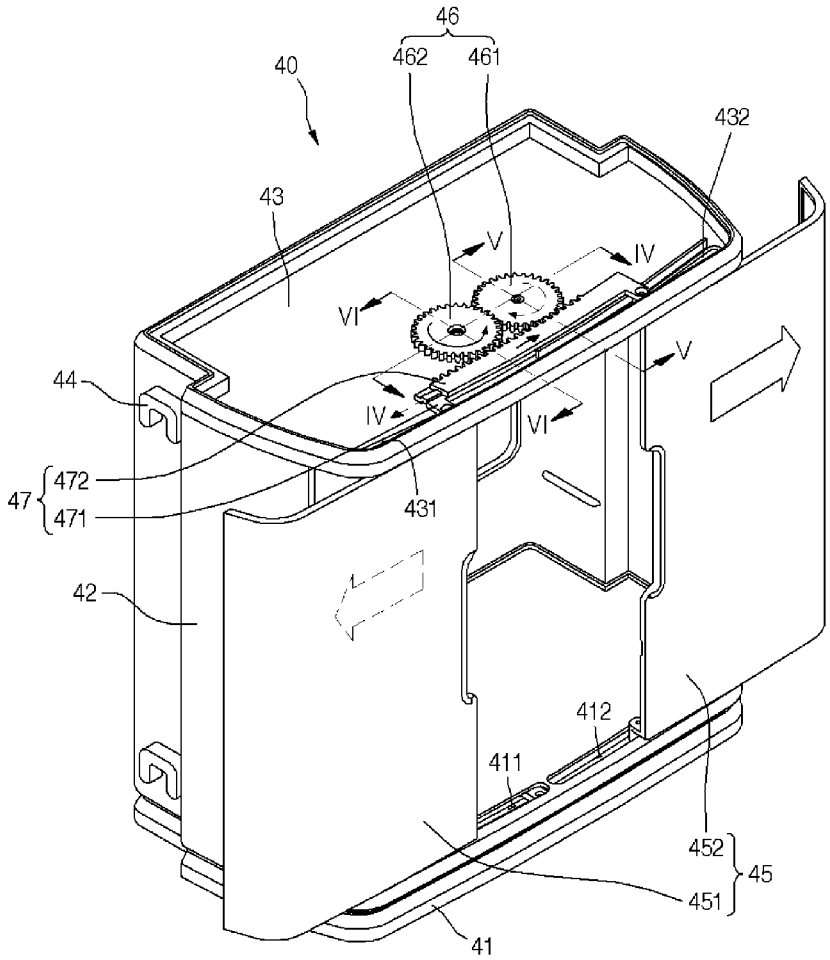
FIG. 16 is a perspective view illustrating a door basket according to an embodiment.

FIG. 16 is a perspective view illustrating a door basket according to an embodiment.

Referring to FIG. 16, the door basket 40 includes: a bottom 41; a body 42 extending upward from an edge of the bottom 41 and having a front opening; an upper part 43 placed on the upper end of the body 42; and covers 45 selectively opening and closing the front opening of the body 42.

In detail, driving mechanisms are provided to the bottom 41 and the upper part 43, respectively, to open and close the covers 45. Although the driving mechanism is exposed in FIG. 16, the driving mechanisms are actually covered by separate cover members.

In more detail, the covers 45 may include a first cover 451 at the left side, and a second cover 452 at the right side. The first and second covers 451 and 452 move in opposite directions to open and close the body 42. Hanger protrusions 44 are disposed on the rear ends of both side surfaces of the body 42, and hanger members coupling to the hanger protrusions 44 are disposed on the rear surface of the refrigerator door 12, so that the door basket 40 can be removably coupled to the refrigerator door 12.

The driving mechanisms include gear members 46 rotatably installed on the bottom 41 and the upper part 43, respectively, and link members 47 connected to the gear members 46.

In detail, the gear member 46 includes a pair of gears engaging with each other and disposed at different levels. That is, the gear member 46 includes a first gear 461 disposed at the lower level, and a second gear 462 disposed at the higher level and engaging with the first gear 461.

The link member 47 includes a first link 471 having a rack on a side surface thereof and engaging with the first gear 461, and a second link 472 having a rack on a side surface thereof and engaging with the second gear 462. The second link 472 is disposed over the first link 471, and moves in the opposite direction to a moving direction of the first link 471.

An end of the first link 471 is connected to an upper or lower edge of the first cover 451, and an end of the second link 472 is connected to an upper or lower edge of the second cover 452. The bottom 41 has guide holes, so that the covers 45 connected to the link member 47 can slide left and right. In detail, the guide holes include a first guide hole 411 receiving a connecting part between the first link 471 and the first cover 451, and a second guide hole 412 receiving a connecting part between the second link 472 and the second cover 452. The upper part 43 includes a first guide hole 431 and a second guide hole 432, which corresponds to the first and second guide holes 411 and 412.

Figure 17:
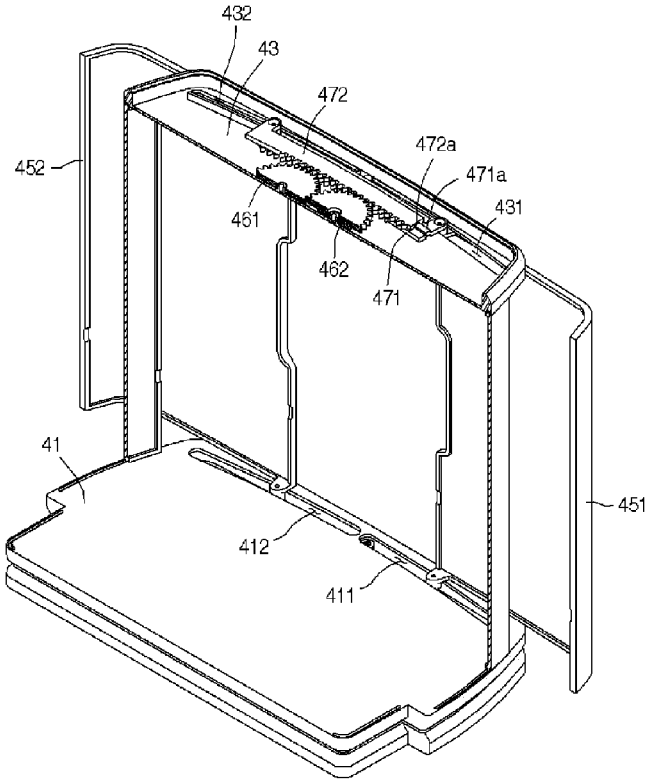
FIG. 17 is a cut-away perspective view taken along line IV-IV of FIG. 16.

FIG. 17 is a cut-away perspective view taken along line IV-IV of FIG. 16.

Referring to FIG. 17, a rotation shaft of the first gear 461 is parallel to a rotation shaft of the second gear 462, and the first and second gears 461 and 462 engage with each other through gear teeth thereof. The second gear 462 is disposed at the higher level than the first gear 461.

The first gear 461 engages with the rack of the first link 471, and the second gear 462 engages with the rack of the second link 472. A guide protrusion **471*a* disposed on the top surface of the first link 471 extends in the longitudinal direction of the first link 471. A guide recess 472*a* receiving the guide protrusion 471*a* is disposed in the bottom surface of the second link 472, and extends in the longitudinal direction of the second link 472. Thus, the second link 472 disposed on the top surface of the first link 471 moves together with the first link 471, and moves in the opposite direction to a moving direction of the first link 471**.

In detail, when the first gear 461 rotates in a certain direction, the second gear 462 engaging with the first gear 461 rotates in the opposite direction to the certain direction. Then, the first link 471 connected to the first gear 461, and the second link 472 connected to the second gear 462 move in opposite directions to each other.

Figure 18:
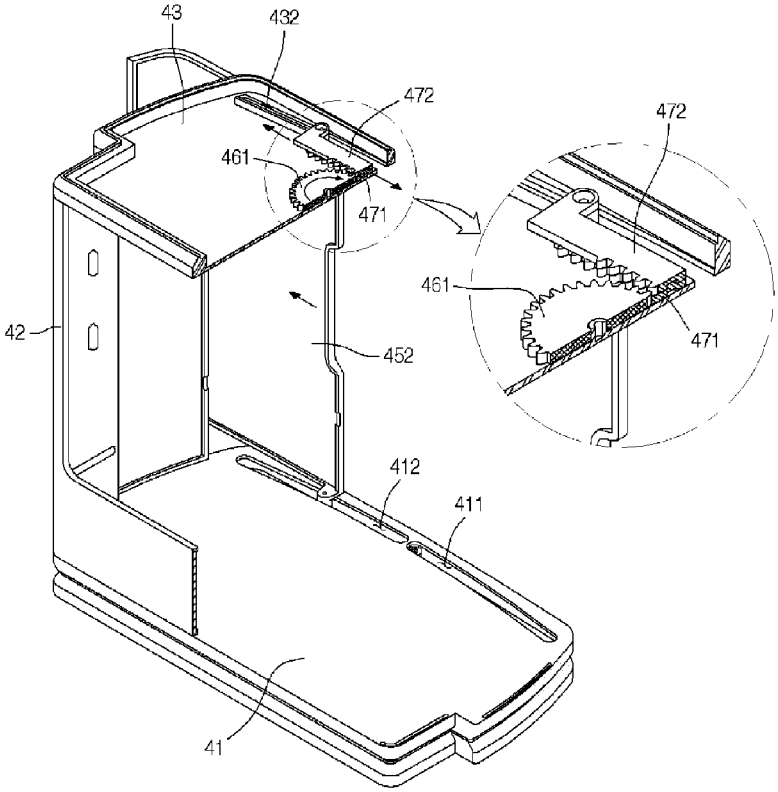
FIG. 18 is a cut-away perspective view taken along line V-V of FIG. 16.
Figure 19:
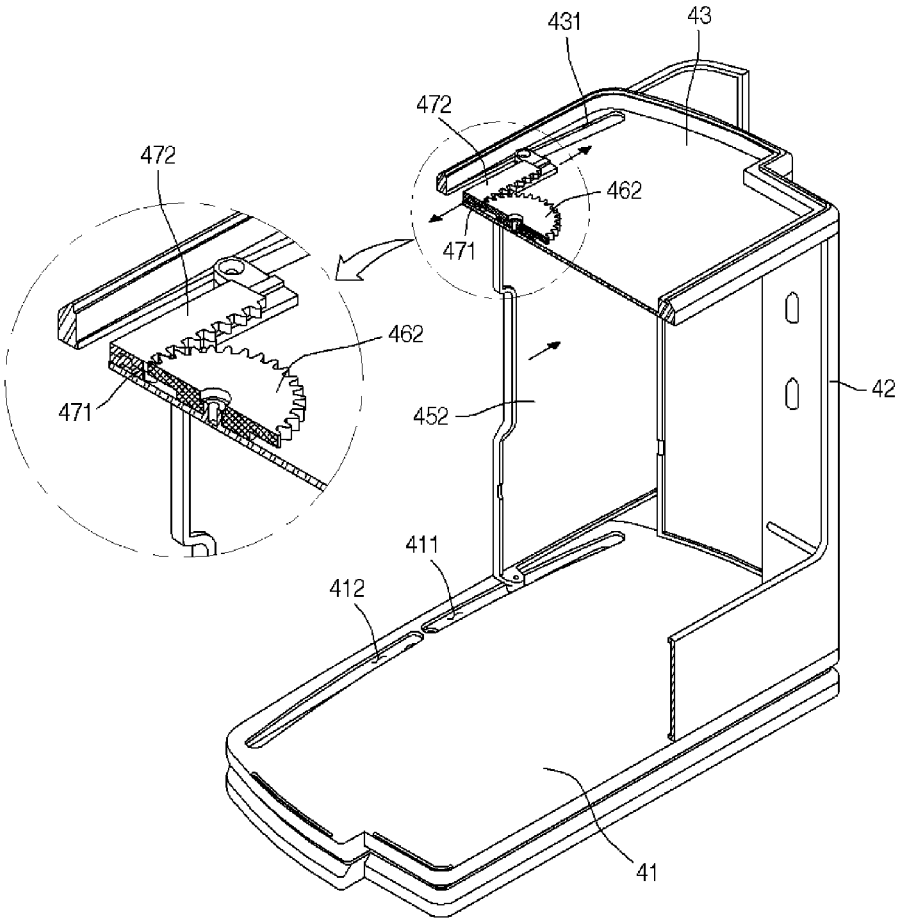
FIG. 19 is a cut-away perspective view taken along line VI-VI of FIG. 16.

FIG. 18 is a cut-away perspective view taken along line V-V of FIG. 16. FIG. 19 is a cut-away perspective view taken along line VI-VI of FIG. 16.

Referring to FIGS. 18 and 19, the first and second gears 461 and 462 engage with the first and second links 471, respectively. To prevent the second link 472 from engaging with the first gear 461, or the first link 471 from engaging with the second gear 462, the following design can be applied.

That is, the rotation shaft of the first gear 461 may be closer to the front surface of the door basket 40 than the rotation shaft of the second gear 462. To this end, the rack disposed on the rear surface of the second link 472 may further protrude rearward than the rack disposed on the rear surface of the first link 471. Accordingly, the rack of the first link 471 is prevented from engaging with the second gear 462.

Alternatively, the first gear 461 and the second gear 462 may be disposed at different levels. Thus, any design can be applied, provided that the first link 471 and the second link 472 engage with the first gear 461 and the second gear 462, respectively.

In detail, when the first gear 461 rotates clockwise as illustrated in FIG. 18, the first link 471 moves right. At this point, the second gear 462 rotates counterclockwise, and the second link 472 moves left. Then, the first and second covers 451 and 452 move in certain directions to open the front opening of the body 42. That is, the first and second covers 451 and 452 move away from each other. When the first gear 461 rotates counterclockwise, the first and second covers 451 and 452 come close to each other to close the front opening of the body 42.

In the driving mechanisms configured as described above, one of the first and second covers 451 and 452 is automatically moved by moving the other. In addition, the first and second covers 451 and 452 move in opposite directions to open or close the inner space of the door basket 40. Thus, while a user opens the cover 45 with his/her hand, the user can put in or take out a food from the door basket 40 with the other hand.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

INDUSTRIAL APPLICABILITY

According to the embodiments, only when a command for dispensing water or ice is input, the display assembly is moved rearward to form a space, thereby improving an appearance, and preventing a foreign substance from being stacked on the dispenser assembly.

The invention claimed is:

1. A refrigerator comprising:
- a main body having a storage space therein;
- a door selectively opening and closing the storage space; and
- a dispenser assembly provided to the door to dispense water or ice,
- wherein the dispenser assembly includes:
  - a dispenser housing having a front opening;
  - a dispenser body moving in a front-to-rear direction according to a water or ice dispensing command;
  - a dispensing button disposed inside the dispenser housing to input the water or ice dispensing command;
  - a dispensing outlet portion to discharge water or ice; and
  - a tray disposed on a bottom of the dispenser housing,
- wherein, when the dispenser body moves rearward, the dispensing outlet portion is exposed to discharge the water or the ice and a space for accommodating a container to receive the water or the ice is established inside the dispenser housing.

2. The refrigerator according to claim 1, further comprising a display that is provided to a front surface of the door corresponding to an exterior of the dispenser assembly,
- wherein the display is configured to appear when the dispensing command is input.

3. The refrigerator according to claim 1, wherein the tray is moved forward or rearward according to manipulation of the dispensing button.

4. The refrigerator according to claim 1, wherein the dispenser assembly further comprises:
- a dispenser head disposed inside the dispenser housing and located above the dispenser body,
- wherein the dispensing button includes:
  - a water dispensing button for inputting the water dispensing command; and
  - an ice dispensing button for inputting the ice dispensing command,
- wherein the water dispensing button is disposed on the dispenser head, and the ice dispensing button is disposed on the dispenser body.

5. The refrigerator according to claim 4, wherein, at least when the ice dispensing button is pressed, the dispenser body is moved rearward.

6. The refrigerator according to claim 4, wherein a front surface of the dispenser head, a front surface of the dispenser body, and a front surface of the door are at least partially flush with one another.

7. The refrigerator according to claim 4, wherein the dispenser body is recessed from the dispenser head.

8. The refrigerator according to claim 4, further comprising an ice chute extending down to a boundary part between the dispenser head and the dispenser body,
- wherein the dispensing outlet portion includes one of or both a water discharge hole and an outlet of the ice chute.

9. The refrigerator according to claim 8, wherein the dispenser body moves rearward to expose the outlet of the ice chute when the ice dispensing command is inputted.

10. The refrigerator according to claim 4, further comprising: a switch that is selectively turned on/off by manipulation of at least one of the water dispensing button and the ice dispensing button, and a control part that is disposed inside the dispenser housing, receives an on/off signal from the switch, and generates a command for operating the dispenser assembly according to the received on/off signal.

11. The refrigerator according to claim 4, further comprising: driving parts connected to the dispenser body and the tray, respectively, to generate driving force for moving the dispenser body and the tray; and transmission parts transmitting the driving force generated by the driving part to the dispenser body and the tray.

12. The refrigerator according to claim 11, wherein the driving part comprises a motor, and the transmission part comprises a pinion connected to a rotation shaft of the motor, and a rack provided to the dispenser body or the tray and engaging with the pinion.

13. The refrigerator according to claim 12, wherein the tray comprises: a stationary tray fixed in the dispenser housing; a moving tray including the rack on a bottom surface thereof, and sliding forward or rearward according to a rotation of the pinion; and a slide guide guiding the sliding of the moving tray.

14. The refrigerator according to claim 13, further comprising: a support having an end disposed in the slide guide, and the other end contacting a bottom surface of the stationary tray; and an elastic member fitted on an circumferential surface of the support to vertically move the stationary tray.

15. A refrigerator comprising:

a main body having a storage space therein;

a door selectively opening and closing the storage space;

a door basket provided on a rear surface of the door and defining a separate storage space; and a dispenser assembly provided to the door to dispense water or ice, wherein the dispenser assembly includes:

a dispenser housing having a front opening;

a dispenser body moving in a front-to-rear direction according to a water or ice dispensing command;

a dispensing button disposed inside the dispenser housing to input the water or ice dispensing command;

a dispensing outlet portion to discharge water or ice; and a tray disposed on a bottom of the dispenser housing, wherein, when the dispenser body mover rearward, the dispensing outlet portion is exposed to discharge the water or the ice and a space for accommodating a container to receive the water or the ice is established inside the dispenser housing, and wherein the door basket comprises:

a bottom;

a body extending from the bottom and having an opening;

an upper part placed on an upper end of the body;

a pair of covers selectively opening and closing the opening of the body; and a driving mechanism configured to allow one of the covers to be automatically moved by a movement of the other one of the covers.

16. The refrigerator according to claim 15, wherein the driving mechanism comprises: a pair of link members connected to the covers, respectively; and a pair of gear members connected to the link members, respectively, and engaging with each other.

17. The refrigerator according to claim 16, wherein the link members comprise: a first link connected to one of the covers; and a second link connected to the other of the covers, and the gear members comprises: a first gear engaging with a rack provided to the first link; and a second gear engaging with a rack provided to the second link.

18. The refrigerator according to claim 17, wherein one of the first link and the second link overlaps a top surface of the other and is coupled thereto.

19. The refrigerator according to claim 18, wherein the first link and the second link are moved in opposite directions to each other by a rotation of one of the first and second gears.

20. The refrigerator according to claim 18, wherein the covers simultaneously come close to each other or go away from each other by a rotation of one of the first and second gears.

21. The refrigerator according to claim 17, wherein one of the first and second gears is disposed at a higher level than the other.

22. The refrigerator according to claim 21, wherein a rotation shaft of the gear disposed at the higher level is disposed at a more rearward position from a front surface of the body than a rotation shaft of the gear disposed at a lower level such that the first and second gears engage with the first and second links, respectively.

* * * * *